US005534398A

United States Patent [19]

Yasuda et al.

[11] Patent Number: 5,534,398

[45] Date of Patent: Jul. 9, 1996

[54] SILVER HALIDE PHOTOGRAPHIC MATERIAL COMPRISING EMULSION LAYER CONTAINING COLOR COUPLER

[75] Inventors: Tomokazu Yasuda; Yukio Karino; Seiya Sakurai; Masataka Ogawa, all of Kanagawa, Japan

[73] Assignee: Fuji Photo Film Co., Ltd., Kanagawa, Japan

[21] Appl. No.: 501,496

[22] Filed: Jul. 12, 1995

[30] Foreign Application Priority Data

Jul. 12, 1994 [JP] Japan ..... 6-160144

[51] Int. Cl.[6] ..... G03C 7/388; G03C 7/396

[52] U.S. Cl. ..... 430/545

[58] Field of Search ..... 430/546, 545, 430/601, 609, 610, 613

[56] References Cited

U.S. PATENT DOCUMENTS

| | | | |
|---|---|---|---|
| 4,353,979 | 10/1982 | Terada et al. | 430/546 |
| 5,019,494 | 5/1991 | Toya et al. | 430/601 |
| 5,378,595 | 1/1995 | Takizawa et al. | 430/546 |

FOREIGN PATENT DOCUMENTS

| | | | |
|---|---|---|---|
| 2186263 | 8/1987 | Japan | 430/546 |

*Primary Examiner*—Lee C. Wright
*Attorney, Agent, or Firm*—Sughrue, Mion, Zinn, Macpeak & Seas

[57] ABSTRACT

A silver halide photographic material comprises at least one silver halide emulsion layer provided on a support. The silver halide emulsion layer contains a color coupler. According to the present invention, the color coupler is contained in particles of a specific polymer dispersed in the silver halide emulsion layer. The specific polymer comprises repeating units represented by the formula (I):

(I)

in which $R^1$ is hydrogen, a halogen atom or an alkyl group having 1 to 4 carbon atoms; each of $R^2$ and $R^3$ is an aliphatic group or an aromatic group, or $R^2$ and $R^3$ are combined with the oxygen atoms and the phosphorus atom to form a heterocyclic ring; and L is a divalent linking group selected from —CO—, —O—, —S—, —$NR^4$—, —$SO_2$—, a divalent aliphatic group, a divalent aromatic group and a combination thereof, and $R^4$ is hydrogen or an aliphatic group.

10 Claims, No Drawings

SILVER HALIDE PHOTOGRAPHIC MATERIAL COMPRISING EMULSION LAYER CONTAINING COLOR COUPLER

FIELD OF THE INVENTION

The present invention relates to a silver halide photographic material. The invention more particularly relates to a silver halide photographic material comprising at lease one silver halide emulsion layer containing a color coupler provided on a support.

BACKGROUND OF THE INVENTION

A color photographic material comprises at lease one silver halide emulsion layer containing a color coupler provided on a support. The silver halide emulsion layer is a hydrophilic colloidal layer. The color coupler is a water-insoluble and oil-soluble compound. Accordingly, the color coupler cannot be solved in a silver halide emulsion, in which silver halide grains are dispersed in an aqueous gelatin solution. The color coupler has been dispersed in the silver halide emulsion layer using a high boiling organic solvent or a surface active agent.

The color coupler must be finely and uniformly dispersed in the emulsion layer to obtain a clear color image. The high boiling organic solvent has been usually used to disperse the color coupler finely and uniformly in the emulsion layer. In more detail, the color coupler has been contained in particles (or droplets) of the high boiling organic solvent. The particles are dispersed in the emulsion layer.

However, the high boiling organic solvent causes some problems in a photographic material. The solvent tends to ooze out from the surface of the photographic material. Further, the organic solvent softens the silver halide emulsion layer. Furthermore, the color coupler is sometimes crystallized in the solvent. The crystallized coupler cannot form a clear color because its reactivity is poor.

In preparation of the silver halide photographic material, a coating solution of a silver halide emulsion layer is sometimes stored. In the coating solution, droplets of the high boiling organic solvent containing a color coupler are dispersed in a silver halide emulsion. The droplets have been sometimes coagulated or precipitated while storing the coating solution. The coagulated or precipitated particles cause problems when coating the solution or filtering the solution. The problems are also caused by the high boiling organic solvent.

Therefore, it is theoretically preferred to disperse the color coupler finely and uniformly in the emulsion layer without use of a high boiling organic solvent. However, it was practically difficult to do so without the organic solvent.

By the way, U.S. Pat. No. 5,264,333 (Yamanouchi et al) discloses a silver halide photographic material having at least one hydrophilic colloidal layer containing a dispersion obtained by emulsifying and dispersing a solution containing at least one oil-soluble dye and at least one water-insoluble, organic solvent-soluble polymer having at least one repeating unit represented by the following general formula (I):

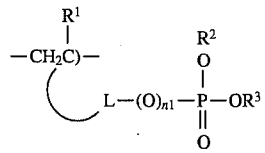

(I)

wherein $R^1$ represents a hydrogen atom, a substituted or unsubstituted alkyl group having 1 to 4 carbon atoms, or a halogen atom; $R^2$ and $R^3$ may be the same or different and each represents a substituted or unsubstituted alkyl group or a substituted or unsubstituted aryl group; L represents a bivalent bonding group; and n1 represents 0 or 1.

The objects of the invention of Yamanouchi et al are to provide a silver halide photographic material which selectively dyes a specific layer and is excellent in decolorizability or an ability of dissolving-out in processing stages (cf., Yamanouchi et al at column 3, lines 35 to 41).

The oil-soluble dye functions as an antihalation dye or an antiirradiation dye, which does not concern a color image formed from a color coupler. Therefore, the dye must be decolorized or dissolved out in processing stages. The above-defined polymer has an excellent function of decolorizing or dissolving out the oil-soluble dye.

On the other hand, the color coupler and the color image formed from the coupler should not be decolorized nor dissolved out in processing stages. Therefore, it has been considered that the above-defined polymer cannot be used in dispersing a color coupler in a silver halide emulsion layer.

SUMMARY OF THE INVENTION

The applicants have further studied the polymer disclosed in U.S. Pat. No. 5,264,333 (Yamanouchi et al), and surprisingly find that the polymer has an excellent function of dispersing a color coupler in a silver halide emulsion layer. The applicants further note that the color coupler and the color image formed from the coupler are not decolorized nor dissolved out in processing stages even though the polymer is used dispersing the color coupler in a silver halide emulsion layer.

An object of the present invention is to provide a silver halide photographic material, in which a color coupler is finely and uniformly dispersed in a silver halide emulsion layer.

Another object of the invention is to provide a silver halide photographic material that contains a color coupler without use of a high boiling organic solvent.

A further object of the invention is to provide a silver halide photographic material, which can be prepared by a stable coating solution in which a color coupler is dispersed in a silver halide emulsion.

The present invention provides a silver halide photographic material comprising at least one silver halide emulsion layer containing a color coupler provided on a support, wherein the color coupler is contained in particles of a polymer dispersed in the silver halide emulsion layer, said polymer comprising repeating units represented by the formula (I):

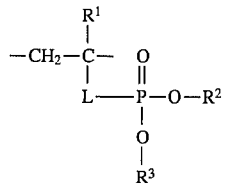

(I)

in which $R^1$ is hydrogen, a halogen atom or an alkyl group having 1 to 4 carbon atoms; each of $R^2$ and $R^3$ independently is an aliphatic group or an aromatic group, or $R^2$ and $R^3$ are combined with the oxygen atoms and the phosphorus atom to form a heterocyclic ring; and L is a divalent linking group selected from —CO—, —O—, —S—, —$NR^4$—, —$SO_2$—, a divalent aliphatic group, a divalent aromatic group and a combination thereof, and $R^4$ is hydrogen or an aliphatic group.

The applicants find that the above-defined polymer has a function of dispersing a color coupler finely and uniformly in a silver halide emulsion layer. Accordingly, the silver halide photographic material can form a clear color image from the finely and uniformly dispersed color coupler. Further, the coupler can be dispersed without use of a high boiling organic solvent. Accordingly, the silver halide photographic material of the present invention is free from the problems caused by the high boiling organic solvent. Furthermore, the particles of the polymer are stable in a coating solution for the silver halide emulsion layer. Accordingly, the silver halide photographic material of the invention can be prepared by a stable coating solution, which can be stored for a long term.

DETAILED DESCRIPTION OF THE INVENTION

The present invention is characterized in that a color coupler is contained in particles of a specific polymer dispersed in the silver halide emulsion layer. The polymer comprises repeating units represented by the formula (I):

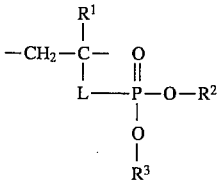

(I)

In the formula (I), $R^1$ is hydrogen, a halogen atom (e.g., chlorine, bromine) or an alkyl group having 1 to 4 carbon atoms (e.g., methyl, ethyl, n-butyl). Hydrogen and methyl are preferred.

In the formula (I), each of $R^2$ and $R^3$ independently is an aliphatic group or an aromatic group, or $R^2$ and $R^3$ are combined with the oxygen atoms and the phosphorus atom to form a heterocyclic ring.

The aliphatic group include an alkyl group, a substituted alkyl group, an alkenyl group, a substituted alkenyl group, an alkynyl group and a substituted alkynyl group. The alkyl group and the substituted alkyl group are preferred.

The alkyl group preferably has a straight chain structure or a branched chain structure, though the alkyl group may have a cyclic structure. The alkyl group preferably has 1 to 50 carbon atoms, more preferably has 1 to 30 carbon atoms, and most preferably has 1 to 20 carbon atoms. Examples of the alkyl groups include methyl, ethyl, n-propyl, isopropyl, n-butyl, isobutyl, n-amyl, n-hexyl, n-heptyl, n-octyl, 2-ethylhexyl, n-nonyl, n-decyl, n-dodecyl and n-octadecyl.

The alkyl moiety of the substituted alkyl group is the same as the above-described alkyl group. Examples of the substituent groups of the substituted alkyl groups include an aryl group (e.g., phenyl), nitro, hydroxyl, cyano, sulfo, an alkoxy group (e.g., methoxy), an aryloxy group (e.g., phenoxy), an acyloxy group (e.g., acetoxy), an amido group (e.g., acetamido), a sulfonamido group (e.g., methanesulfonamido), a sulfamoyl group (e.g., methylsulfamoyl), a halogen atom (e.g., fluorine, chlorine, bromine), carboxyl, a carbamoyl group (e.g., methylcarbamoyl), an alkoxycarbonyl group (e.g., methoxycarbonyl) and a sulfonyl group (e.g., methylsulfonyl). The aryl group and the alkoxy group are preferred. Two or more substituent groups may be attached to the substituted alkyl group.

The aromatic group include an aryl group and a substituted aryl group.

The aryl group preferably has 6 to 50 carbon atoms, more preferably has 6 to 30 carbon atoms, and most preferably has 6 to 20 carbon atoms. Examples of the alkyl groups include phenyl and naphthyl.

The aryl moiety of the substituted aryl group is the same as the above-described aryl group. Examples of the substituent groups of the substituted aryl groups include an alkyl group (e.g., methyl ethyl), nitro, hydroxyl, cyano, sulfo, an alkoxy group (e.g., methoxy), an aryloxy group (e.g., phenoxy), an acyloxy group (e.g., acetoxy), an amido group (e.g., acetamido), a sulfonamido group (e.g., methanesulfonamido), a sulfamoyl group (e.g., methylsulfamoyl), a halogen atom (e.g., fluorine, chlorine, bromine), carboxyl, a carbamoyl group (e.g., methylcarbamoyl), an alkoxycarbonyl group (e.g., methoxycarbonyl) and a sulfonyl group (e.g., methylsulfonyl). The alkyl group, the alkoxycarbonyl group and the halogen atom are preferred. Two or more substituent groups may be attached to the substituted aryl group.

Examples of the heterocyclic ring formed from $R^2$, $R^3$, the oxygen atoms and the phosphorus atom in the formula (I) include

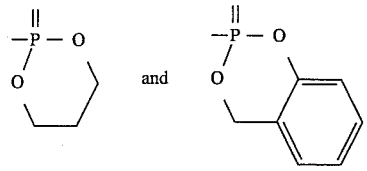

In the formula (I), L is a divalent linking group selected from —CO—, —O—, —S—, —$NR^4$—, —$SO_2$—, a divalent aliphatic group, a divalent aromatic group and a combination thereof.

Examples of the divalent linking groups formed by the combinations include the following L1 to L8:

L1: —CO—O—AL—O—

L2: —AR—AL—O—

L3: —CO—O—AL—O—CO—AL—O—

L4: —CO—$NR^4$—AR—O—

L5: —CO—$NR^4$—AL—O—

L6: —CO—O—AL—

L7: —AR—AL—

L8: —AR—AL—O—AL— in which the right side is attached to the phosphorous atom and the left side is attached to the carbon atom; AL is a divalent aliphatic group; AR is a divalent aromatic group; and $R^4$ is hydrogen or an aliphatic group.

The aliphatic group of $R^4$ has the same meanings as those described about $R^2$ and $R^3$. The divalent aliphatic group is formed by removing one hydrogen atom form the aliphatic group described about $R^2$ and $R^3$. The divalent aromatic group is also formed by removing one hydrogen atom from the aromatic group described about $R^2$ and $R^3$. $R^4$ is hydrogen or an aliphatic group.

Examples of the repeating units represented by the formula (I) are shown below.

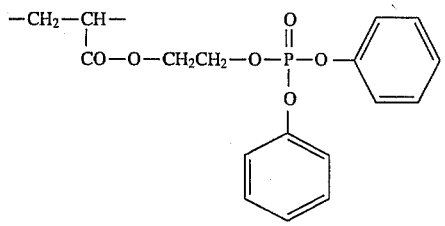
(I-1)

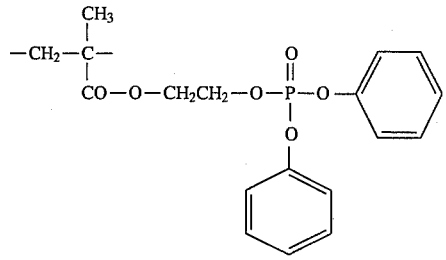
(I-2)

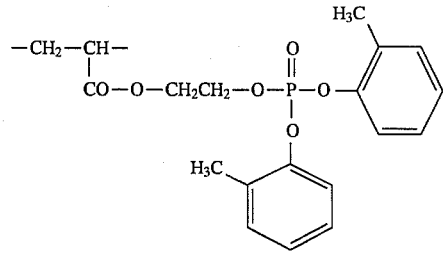
(I-3)

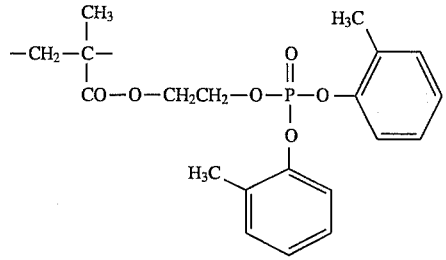
(I-4)

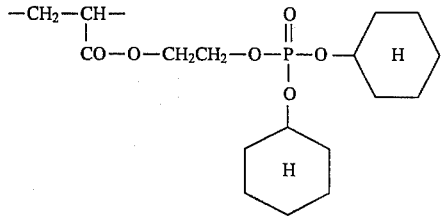
(I-5)

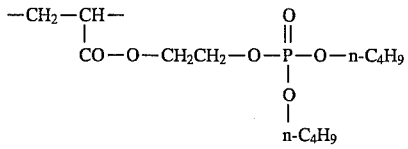
(I-6)

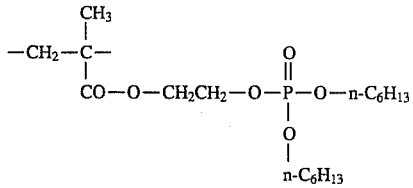
(I-7)

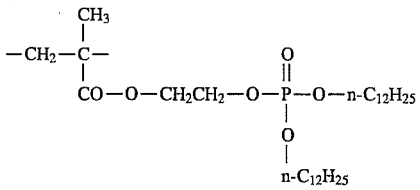
(I-8)

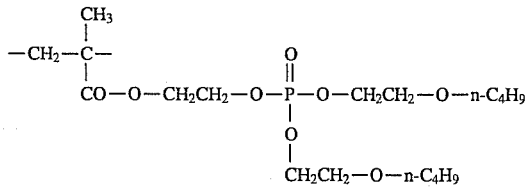
(I-9)

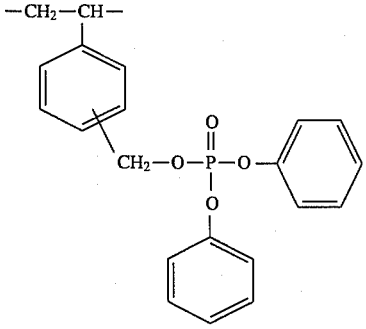
(I-10)

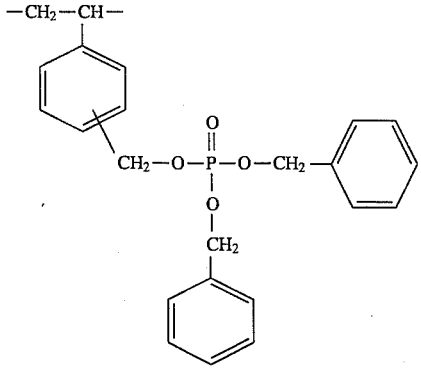
(I-11)

-continued
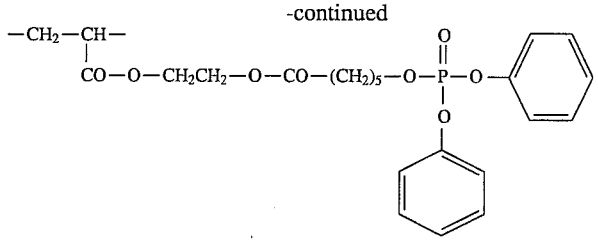
(I-12)
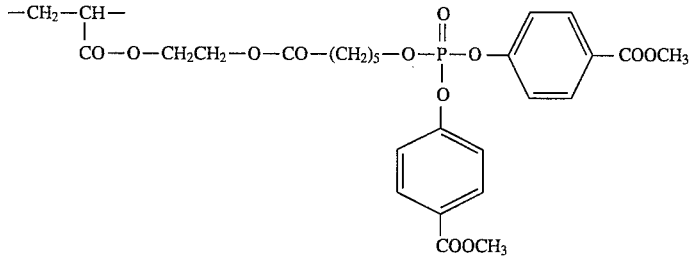
(I-13)
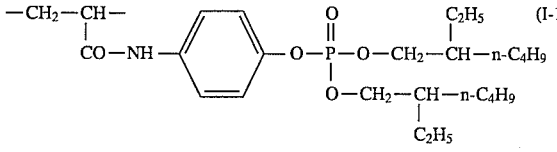
(I-14)
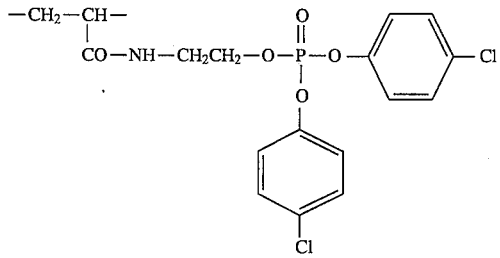
(I-15)
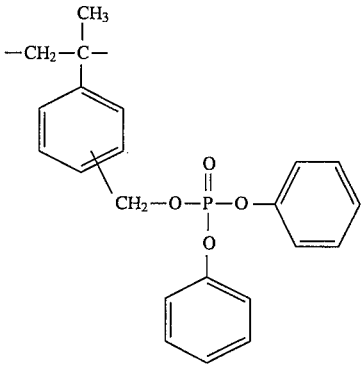
(I-16)
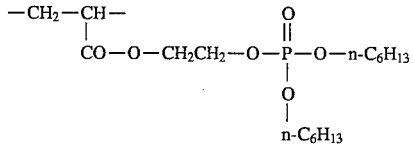
(I-17)
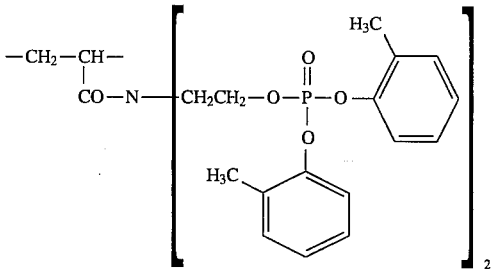
(I-18)
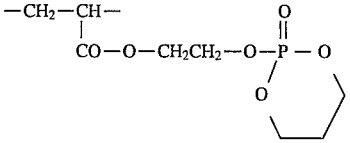
(I-19)
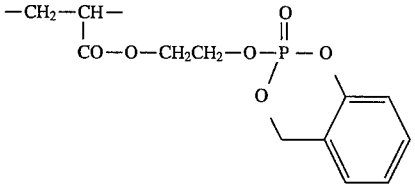
(I-20)

-continued (I-21)

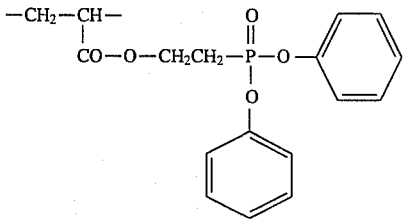

(I-22)

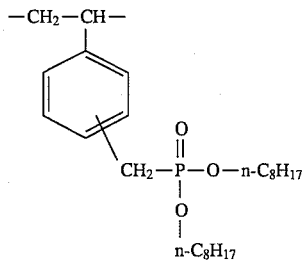

(I-23)

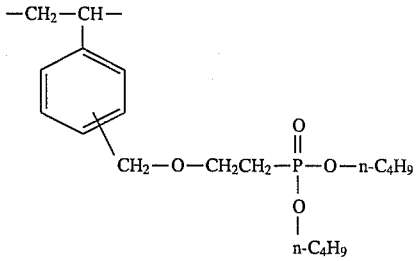

(I-24)

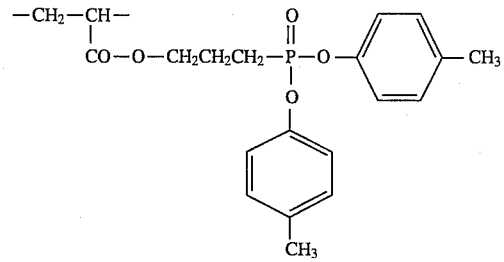

(I-25)

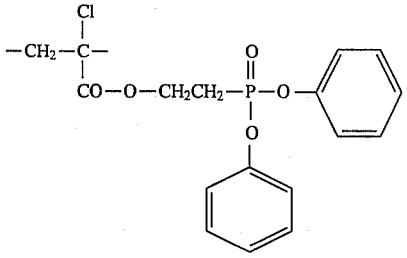

(I-26)

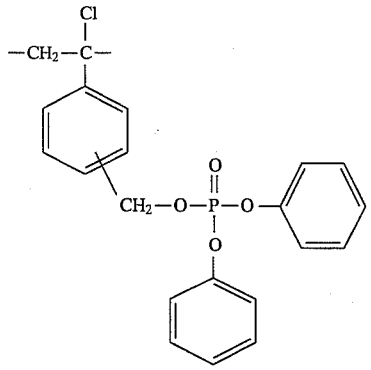

The polymer may be a homopolymer consisting of the repeating units represented by the formula (I).

Examples of the homopolymers are shown below.

| Polymer | Repeating units | Mn (Number average molecular weight) |
|---|---|---|
| P-1 | I-1 | 18,000 |
| P-2 | I-2 | 19,000 |
| P-3 | I-3 | 6,500 |
| P-4 | I-5 | 75,000 |
| P-5 | I-12 | 33,000 |
| P-6 | I-14 | 17,000 |

Two or more kinds of repeating units represented by the formula (I) may be used in combination to form a copolymer. An example of the copolymer is shown below.

| Polymer | Repeating units | Ratio of units | Mn |
|---|---|---|---|
| P-7 | I-1/I-2 | 50/50 | 44,000 |

The polymer may also be a copolymer comprising the repeating units represented by the formula (I) with other repeating units.

The other repeating units can be derived from various ethylenically unsaturated monomers such as alkenoic acids, alkenoic esters, alkenesulfonic acids, vinyl esters, acrylamides, methacrylamides, olefins, styrenes, vinyl ethers, vinyl ketones, N-vinyl heterocyclic compounds and olefin nitriles.

Examples of the alkenoic acids include acrylic acid, methacrylic acid, itaconic acid, maleic acid and citraconic acid.

The alkenoic esters are formed from the above-mentioned alkenoic acid with an alcohol.

Examples of the acrylic esters include methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 2-methoxyethyl acrylate, 3-methoxybutyl acrylate, 2-ethoxyethyl acrylate, 2-iso-propoxyethyl acrylate, 2-butoxyethyl acrylate, 2-(2-methoxyethoxy) ethyl acrylate, 2-(2-butoxyethoxy)ethyl acrylate, ω-methoxypolyethylene glycol acrylate (addition moles: n=9), 1-bromo-2-methoxyethyl acrylate, 1,1-dichloro-2-ethoxyethyl acrylate and glycidyl acrylate.

Examples of the methacrylic esters are the same as the examples of the acrylic esters except that acrylic is replaced with methacrylic.

Examples of the other alkenoic esters include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, monoalkyl itaconates (e.g., monomethyl itaconate, monoethyl itaconate) and monoalkyl maleates (e.g., monomethyl maleate, monoethyl maleate).

Examples of the alkenesulfonic acids include styrenesulfonic acid, vinylbenzylsulfonic acid, vinylsulfonic acid, acryloyloxyalkylsulfonic acids (e.g., acryloyloxymethylsulfonic acid, acryloyloxyethylsulfonic acid, acryloyloxyethylsulfonic acid), methacryloyloxylalkylsulfonic acids (e.g., methacryloyloxymethylsulfonic acid, methacryloyloxyethylsulfonic acid, methacryloyloxypropylsulfonic acid), acrylamidoalkylsulfonic acids (e.g., 2-acrylamido-2-methylethanesulfonic acid, 2-acrylamido-2-methylpropanesulfonic acid, 2-acrylamido-2-methylbutanesulfonic acid) and methacrylamidoalkylsulfonic acids (e.g., 2-methacrylamido-2-methylethanesulfonic acid, 2-methacrylamido-2-methylpropanesulfonic acid, 2-methacrylamido-2-methylbutanesulfonic acid).

Examples of the vinyl esters include vinyl acetate, vinyl propionate, vinyl butyrate, vinyl isobutyrate, vinyl caproate, vinyl chloroacetate, vinyl methoxyacetate, vinyl phenylacetate, vinyl benzoate and vinyl salicylate.

Examples of the acrylamides include acrylamide, N-methylacrylamide, N-ethylacrylamide, N-propylacrylamide, N-butylacrylamide, N-tert-butylacrylamide, N-cyclohexylacrylamide, N-benzylacrylamide, N-hydroxymethylacrylamide, N-methoxyethylacrylamide, N-dimethylamminoethylacrylamide, N-phenylacrylamide, N,N-dimethylacrylamide, N,N-diethylacrylamide, N-β-cyanoethylacrylamide, N-(2-acetoacetoxyethyl)acrylamide and N,N-diacetoneacrylamide.

Examples of the methacrylamides are the same as the examples of the acrylamides except that acryl is replaced with methacryl.

Examples of the olefins include dicyclopentadiene, ethylene, propylene, 1-butene, 1-pentene, vinyl chloride, vinylidene chloride, isoprene, chloroprene, butadiene and 2,3-dimethylbutadiene.

Examples of the styrenes include methylstyrene, dimethylstyrene, trimethylstyrene, ethylstyrene, isopropylstyrene, chloromethylstyrene, dichlorostyrene, bromostyrene and methyl vinylbenzoate.

Examples of the vinyl ethers include methyl vinyl ether, butyl vinyl ether, hexyl vinyl ether, methoxyethyl vinyl ether and dimethylaminoethyl vinyl ether.

Examples of the vinyl ketones include methyl vinyl ketone, phenyl vinyl ketone and methoxyethyl vinyl ketone.

Examples of the N-vinyl heterocyclic compounds include N-vinyloxazolidone and N-vinylpyrrolidone.

Examples of the olefin nitriles include acrylonitrile, methacrylonitrile and methylenemalononitrile.

The copolymer preferably comprises the repeating units represented by the formula (I) and other repeating units having an acidic group. Accordingly, the other repeating units are preferably derived from alkenoic acids, alkenoic acidic esters (e.g., a monoester of dicarboxylic acid) and alkenesulfonic acids. The acidic group in the repeating unit may be in the form of a salt. The salt may be formed with the acidic group with an alkali metal ion (e.g., $Na^+$, $K^+$) or ammonium ion.

Examples of the preferred acidic repeating units are shown below.

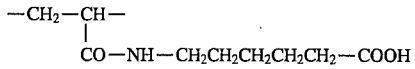
(II-1)

-continued

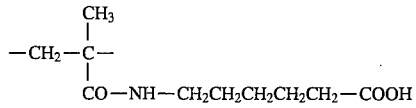
(II-2)

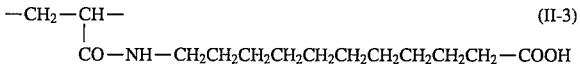
(II-3)

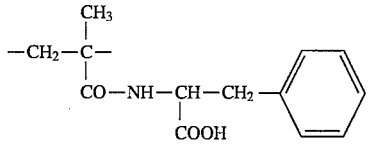
(II-4)

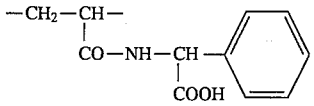
(II-5)

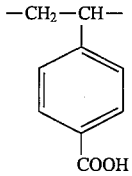
(II-6)

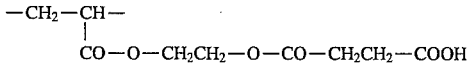
(II-7)

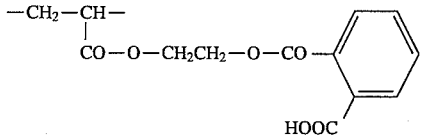
(II-8)

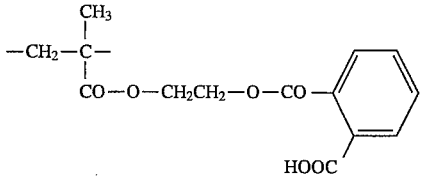
(II-9)

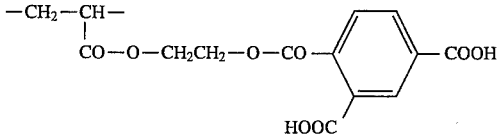
(II-10)

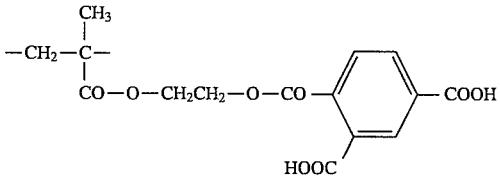
(II-11)

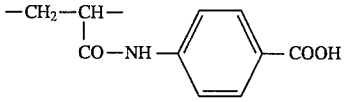
(II-12)

-continued
(II-13)
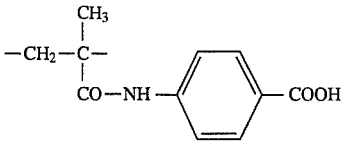
(II-14)
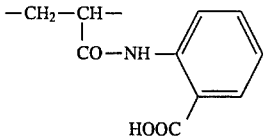
(II-15)
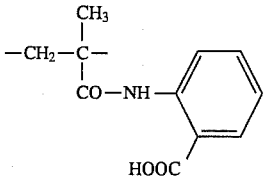
(II-16)
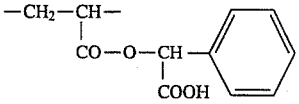
(II-17)
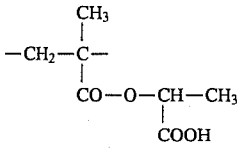
(II-18)
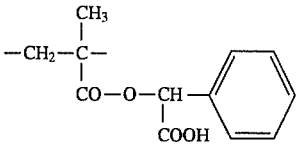
(II-19)
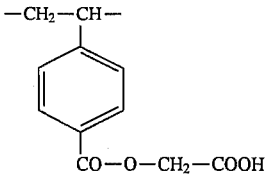
(II-20)
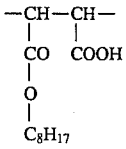
(II-21)
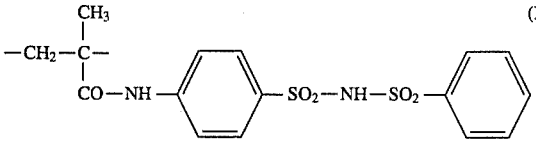
(II-22)
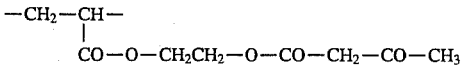
(II-23)
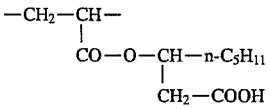
(II-24)
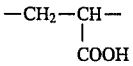
-continued
(II-25)
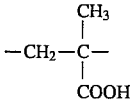
(II-26)
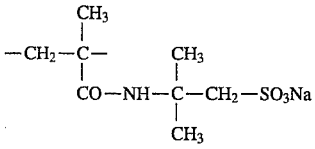
The acidic repeating units preferably have such a character that a homopolymer of the units is insoluble in water at pH of lower than 6, but is soluble in water at pH of higher than 10.
Examples of the other preferred repeating units are shown below.
(III-1)
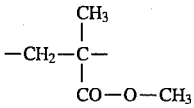
(III-2)
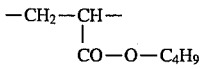
(III-3)
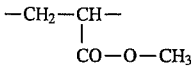
(III-4)
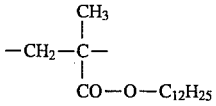
(III-5)
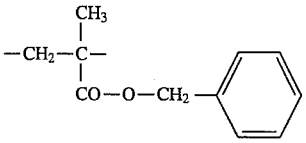
(III-6)
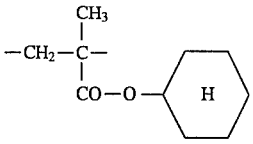
(III-7)
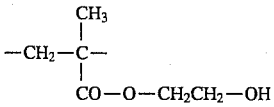
(III-8)
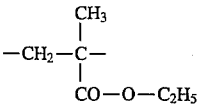
(III-9)
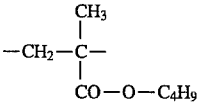
(III-10)
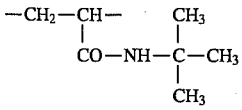
(III-11)
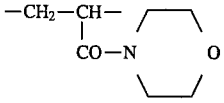

The copolymer preferably comprises the repeating units represented by the formula (I) in the weight ratio of not less than 30 wt. %, and more preferably of not less than 50 wt. %.

The copolymer preferably further comprises the acidic repeating units in the weight ratio of 1 to 70 wt. %, and more preferably of 3 to 50 wt. %. In the case that the acidic repeating units are hydrophilic, the weight ratio is further preferably in the range of 3 to 30 wt. %, and most preferably in the range of 3 to 15 wt. %.

Examples of the copolymers are shown below.

| Polymer | Repeating units | Ratio of units | Mn |
|---|---|---|---|
| P-8 | I-1/III-1 | 90/10 | 15,000 |
| P-9 | I-1/III-1 | 70/30 | 20,000 |
| P-10 | I-1/III-1 | 50/50 | 24,000 |
| P-11 | I-2/III-1 | 80/20 | 27,000 |
| P-12 | I-1/II-24 | 95/5 | 14,000 |
| P-13 | I-1/II-24 | 90/10 | 12,000 |
| P-14 | I-2/II-25 | 95/5 | 27,000 |
| P-15 | I-1/II-14 | 70/30 | 8,500 |
| P-16 | I-1/II-15 | 90/10 | 19,000 |
| P-17 | I-1/II-15 | 70/30 | 17,000 |
| P-18 | I-1/II-15 | 50/50 | 16,000 |
| P-19 | I-2/II-15 | 70/30 | 24,000 |
| P-20 | I-10/III-2/II-13 | 60/20/20 | 61,000 |
| P-21 | I-11/III-3/II-26 | 60/37/3 | 95,000 |
| P-22 | I-2/I-10/III-1/III-4 | 50/10/30/10 | 11,000 |
| P-23 | I-4/III-5/II-8 | 60/30/10 | 14,000 |
| P-24 | I-3/III-6/III-7 | 50/30/20 | 35,000 |
| P-25 | I-1/III-2 | 60/40 | 48,000 |
| P-26 | I-16/III-8 | 50/50 | 33,000 |
| P-27 | I-2/I-20/III-9/II-18 | 40/20/20/20 | 25,000 |
| P-28 | 1-18/III-10/III-3 | 60/20/20 | 12,000 |
| P-29 | I-1/III-2/III-11 | 50/40/10 | 3,800 |
| P-30 | I-19/III-1/II-3 | 70/25/5 | 15,000 |

The polymer has a number average molecular weight preferably in the range of 1,000 to 300,000, and more preferably in the range of 2,000 to 100,000.

Two or more polymers can be used in combination.

In the present invention, particles of the polymer are dispersed in a silver halide emulsion layer. A color coupler is contained in the particles.

The particles of the polymer preferably has an average particle size in the range of 20 nm to 1 μm. The shape of the particle is sphere or amorphous.

The polymer is preferably contained in the silver halide emulsion layer in an amount of 5 to 2,000 wt. %, and more preferably of 10 to 1,000 wt. % based on the amount of the color coupler.

An organic solvent can be mixed with the polymer to form the particles. The organic solvent has a function of decreasing the viscosity of a polymer solution. The organic solvent preferably has a boiling point of not higher than 100° C. (more preferably in the range of 30° to 80° C.).

Examples of the low boiling organic solvents include propylene carbonate, methyl acetate, ethyl acetate, isopropyl acetate, butyl acetate, ethyl propionate, sec-butyl alcohol, methyl ethyl ketone, 2-pentanone, 3-pentanone, cyclohexanone, dimethylformamide and dimethyl sulfoxide. The organic solvent preferably has such a character that the viscosity of a solution of 30 g of the polymer in 100 cc of the solvent is not more than 5,000 cps (more preferably not more than 2,000 cps). The amount of the low boiling point organic is determined according to the viscosity of the solution of the polymer in the solvent. The weight ratio of the polymer to the solvent is preferably in the range of 1:1 to 1:50. The amount of the polymer is preferably in the range of 0.1 to 500 wt. %, more preferably in the range of 50 to 300 wt. % based on the total amount of the solvent and the coupler.

According to the present invention, a color coupler can be dispersed in a silver halide emulsion layer without use of a high boiling point organic solvent. The high boiling point means a temperature higher than 100° C. The silver halide emulsion layer may substantially not contain the high boiling point organic solvent. However, a relatively small amount (for example not more than 1 wt. % of the emulsion layer) can be used. Examples of high boiling organic solvents include phthalic esters (e.g., dibutyl phthalate, dicyclohexyl phthalate, di-2-ethylhexyl phthalate, bis(2,4-di-tert-amylphenyl)isophthalate, bis(1,1-diethylpropyl)phthalate), phosphoric or phosphonic esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate), benzoic esters (e.g., 2-ethylhexyl benzoate, dodecyl benzoate, 2-ethylhexyl p-hydroxybenzoate), amides (e.g., N,N-diethyldecaneamide, N,N-diethyllaurylamide, N-tetradecylpyrrolidone), alcohols and phenols (e.g., isostearyl alcohol, 2,4-di-tert-amylphenol), aliphatic carboxylic esters (e.g., bis(2-ethylhexyl)sebacate, dioctyl azelate, glycerol tributylate, isostearyl lactate, trioctyl citrate), aniline derivatives (e.g., N,N-dibutyl-2-butoxy-5-tert-octylaniline) and hydrocarbons (e.g., paraffin, dodecylbenzene, diisopropylnaphthalene).

In preparation of the particles of the polymer containing a color coupler, the coupler is dispersed or a solution of the coupler is emulsified in water or a hydrophilic colloidal solution in the presence of the polymer. The solution of the coupler in the above-mentioned organic solvent is preferably used. The weight ratio of the solvent to the coupler is preferably in the range of 0.1 to 100.

The particles of the polymer and the coupler are preferably prepared using a dispersing or emulsifying machine. Dispersing devices having a high sharing force such as a device of a high speed stirring rate and a device using a high ultrasonic energy are preferably used. Examples of the devices include a colloid mill, a homogenizer, a capillary emulsifying device, a liquid siren, an ultrasonic wave generator of an electromagnetic striction type and an emulsifying device having Paulman's whistle. Further, a dissolver, a polytron, a homomixer, a homoblender, a Keddy mill and a jet agitator can also be used. The devices has a dispersing portion of a high speed rotation (500 to 15,00 rpm, preferably 2,000 to 4,000 rpm). A dissolver and a high speed impeller dispersing device are preferably used in the present invention. Japanese Patent Provisional Publication No. 55(1980)-129136 discloses a preferred dispersing device, which has impellers of saw-like plates bent along the axial direction attached to an axis rotating at a high speed.

In the preparation of the particles of the polymer containing a color coupler, the polymer is added to the solution of the coupler, or is added to water or an aqueous hydrophilic colloidal solution. The polymer is preferably added to the coupler solution.

The solution of the coupler may be added to water or the aqueous solution. Water or the aqueous solution may also be added to the solution of the coupler reversibly. The reversal addition method is preferably used to obtain a fine dispersion.

The solution of the coupler is preferably added to an aqueous hydrophilic colloidal solution. The hydrophilic colloid is preferably the same as the protective colloid or the binder used in the silver halide emulsion layer. Gelatin is usually used as the protective colloid or the binder.

Lime-treated gelatin and acid treated gelatin can be used. Further, hydrolyzed gelatin and enzymatic decomposed gelatin can also be used. Furthermore, gelatin derivatives can be used. The gelatin derivatives are obtained by a reaction of gelatin with acid halides, acid anhydrides, isocyanates, bromoacetic acid, alkaline sultones, vinylsulfonamides, maleinimides, polyalkyleneoxides or epoxy compounds.

The color coupler and the other additives are described below.

The color coupler reacts with an oxidation product of an aromatic primary amine developing agent to form a dye. The hue of the formed dye is usually yellow, magenta, cyan or black.

The yellow coupler usually is an acylacetamide coupler of an oil protect type. Examples of the yellow coupler is described in U.S. Pat. Nos. 2,407,210, 2,875,057 and 3,265,506. A divalent yellow coupler can also be used. Examples of the divalent yellow couplers include a coupler of an oxygen atom releasing type (disclosed in U.S. Pat. Nos. 3,408,194, 3,447,928, 3,933,501 and 4,022,620) and a coupler of a nitrogen atom releasing type (disclosed in Japanese Patent Publication No. 58(1983)-10739, U.S. Pat. Nos. 4,401,752, 4,326,024, Research Disclosure No. 18053 (April 1979), U.S. Pat. No. 1,425,020, West German Patent Publications No. 2,219,917, No. 2,261,361, No. 2,329,587 and No. 2,433,812. A yellow coupler of α-pivaloylacetoanilide type can form a stable dye, which is particularly excellent in stability to light. Further, a yellow coupler of α-benzoylacetoanilide type is excellent in the high color density.

Preferred yellow couplers are disclosed in U.S. Pat. Nos. 3,933,501, 4,022,620, 4,326,024, 4,401,752, 4,248,961, Japanese Patent Publication No. 58(1983)-10739, British Patents No. 1,425,020, No. 1,476,760, U.S. Pat. Nos. 3,973,968, 4,314,023, 4,511,649 and European Patent Publication No. 249,473A.

A preferred magenta coupler is an indazolone or cyanoacetol coupler of an oil protect type. A 5-pyrazolone or pyrazoloazole (e.g., pyrazolotriazole) coupler is further preferred. The 5-pyrazolone coupler is preferably substituted with an arylamino group or an acylamino at the 3-position to obtain an appropriate hue and color density. The 5-pyrazolone couplers are described in U.S. Pat. Nos. 2,311,082, 2,343,703, 2,600,788, 2,908,573, 3,062,653, 3,152,896 and No. 3,936,015. A divalent 5-pyrazolone coupler preferably has a nitrogen atom releasing group (disclosed in U.S. Pat. No. 4,310,619) or an arylthio group (disclosed in U.S. Pat. No. 4,351,897). A 5-pyrazolone coupler having a ballast group (disclosed in European Patent No. 73,636) can form a high color density.

Examples of the pyrazoloazole magenta couplers include pyrazolobenzimidazoles (disclosed in U.S. Pat. No. 3,369,879), pyrazolo[5,1-c][1,2,4]triazoles (disclosed in U.S. Pat. No. 3,725,067) and pyrazoloazoles (disclosed in Research Disclosure No. 24220 (June 1984)). Imidazo[1,2-b]pyrazoles (disclosed in European Patent No. 119,741) and pyrazolo[1,5-b][1,2,4]triazoles (disclosed in European Patent No. 119,860) are preferred because they have a low subabsorption within the yellow range and they form dyes stable to light.

Preferred magenta couplers are disclosed in U.S. Pat. Nos. 4,310,619, 4,351,897, European Patent No. 73,636, U.S. Pat. Nos. 3,061,432, 3,725,067, Research Disclosure No. 24220 (June 1984), Japanese Patent Provisional Publication No. 60(1985)-33552, Research Disclosure No. 24230 (June 1994), Japanese Patent Provisional Publications No. 60(1985)-43659, No. 61(1986)-72238, No. 60(1985)-35730, No. 55(1980)-118034, No. 60(1985)-185951, U.S. Pat. Nos. 4,500,630, 4,540,654, 4,556,630 and International Patent Publication No. 88/04795.

A preferred cyan coupler is a naphthol or phenol coupler of an oil protect type. The naphthol coupler is disclosed in U.S. Pat. No. 2,474,293. A divalent naphthol coupler of oxygen atom releasing type is disclosed in U.S. Pat. Nos. 4,052,212, 4,146,396, 4,228,233 and 4,296,200. The phenol coupler is disclosed in U.S. Pat. Nos. 2,369,929, 2,801,171, 2,772,162 and 2,895,826. The cyan coupler is preferably stable to change of humidity and temperature. Examples of the stable couplers include a phenol cyan coupler having an alkyl (ethyl or more) group at the meta position of the phenol ring (disclosed in U.S. Pat. No. 3,772,002), 2,5-diacylamino substituted phenol coupler (disclosed in U.S. Pat. Nos. 2,772,162, 3,758,308, 4,126,396, 4,334,011, 4,327,173, West German Patent Publication No. 3,329,729 and Japanese Patent Provisional Publication No. 59(1984)-166956) and 2-phenylureido and 5-acylamino phenol coupler (disclosed in U.S. Pat. Nos. 3,446,622, 4,333,999, 4,452,559 and 4,427,767.

Further, Japanese Patent Provisional Publications No. 60(1985)-237448, No. 61(1986)-153640 and No. 61(1986)-14557 disclose 5-sulfonamido or amido naphthol couplers, which can form a stable color. Furthermore, Japanese Patent Provisional Publications No. 64(1989)-553, No. 64(1989)-554, No. 64(1989)-555 and No. 64(1989)-556 disclose pyrazoloazole couplers. U.S. Pat. No. 4,818,672 discloses imidazole couplers.

Preferred cyan couplers are disclosed in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, West German Patent Publication No. 3,329,729, European Patents No. 121,365A, No. 249,453A, U.S. Pat. Nos. 3,446,622, 4,333,999, 4,775,616, 4,451,559, 4,427,767, 4,690,889, 4,254,212, 4,296,199 and Japanese Patent Provisional Publication No. 61(1986)-42658.

The present invention may use a polymer color coupler, which is disclosed in U.S. Pat. Nos. 3,452,820, 4,080,211, 4,367,282, 4,409,320, 4,576,910, British Patent No. 2,102,137 and European Patent No. 341,188A.

A coupler can form an adequately diffusible dye. Such a coupler is disclosed in U.S. Pat. No. 4,366,237, British Patent No. 2,125,570, European Patent No. 96,570 and West German Patent Provisional Publication No. 3,234,533.

The other photographic additives include a color image donating redox compound, a stain inhibitor, an antifogging agent, a development inhibitor, a developing agent, an auxiliary developing agent, a discoloration inhibitor, a color stain inhibitor, a nucleating agent, a color image stabilizer, a silver halide solvent and a bleaching accelerator. These additives are described in Research Disclosure No. 17643, No. 18716 and No. 307105.

The photographic material of the present invention may contain an electron donor which can donate an electron to an oxidized state of a dye donating compound or an oxidation product of a color developing agent. The electron donor is described in T. H. James, The Theory of the Photographic Process, the fourth edition, the chapter 11. The disclosed donor has a partial structure of Kendall-Pliz. Examples of the donors include hydroquinones, catechols, o-aminophenols and p-aminophenols. The electron donor preferably is scarcely diffusible. Non-diffusible or scarcely diffusible hydroquinones or pyrogallols can be used as a color stain inhibitor, an antioxidant or a discoloration inhibitor. Examples of these compounds include 2,5-di-n-octylhydroquinone, 2,5-di-pentadecylhydroquinone, n-dodecyl gallate and p-laulylamidopyrogallol.

Examples of the antifogging agents and the development inhibitors include mercaptotetrazoles, mercaptotriazoles, mercaptopyrimidines, mercaptobenzimidazoles, mercaptothiazoles, benzotriazoles and imidazoles. Examples of the developing agents include p-phenylenediamines, hydroquinones and p-aminophenols. Examples of the auxiliary developing agents include pyrazolidones. Examples of the nucleating agents include hydrazines and hydrazides. Examples of the silver halide solvents include hypos.

The photographic additives can be used in the form of a precursor. Examples of the precursors include DIR- or DAR-hydroquinones. The precursor may have a timing group which releases a photographic agent. Examples of the timing groups include a group which can release an agent by an intramolecular ring closing reaction (disclosed in Japanese Patent Provisional Publication No. 54(1979)-145135), a group releasing an agent by an intramolecular electron transferring reaction (disclosed in British Patent No. 2,072,363 and Japanese Patent Provisional Publication No. 57(1982)-154234), a group releasing an agent by a decarboxylation reaction (disclosed in Japanese Patent Provisional Publication No. 57(1982)-179842) and a group releasing an agent by a deformaldehyde reaction (disclosed in Japanese Patent Provisional Publication No. 59(1984)-93442).

EXAMPLE 1

An undercoating layer was provided on a cellulose triacetate film to prepare a support. The following coating solutions were simultaneously coated on the undercoating layer to prepare a multi-layered color photographic material (sample No. 101).

Preparation of sample No. 101

In the following layers, the amount is the coating amount of g/m$^2$, except that the amount of silver halide means the coating amount (g/m$^2$) of silver and that the amount of the sensitizing dye means the coating amount (mol) based on 1 mol of silver halide.

| | |
|---|---|
| Eighth layer (second protective layer) | |
| H-1 | 0.40 |
| Particles of B-1 (particle size: 1.7 μm) | $5.0 \times 10^{-2}$ |
| Particles of B-2 (particle size: 1.7 μm) | 1.40 |
| B-3 | 0.10 |
| Q-1 | 0.20 |
| Gelatin | 1.20 |
| Seventh layer (first protective layer) | |
| Emulsion E | 0.20 |
| U-4 | 0.11 |
| U-5 | 0.17 |
| Tricresyl phosphate (high boiling solvent) | $5.0 \times 10^{-2}$ |
| Gelatin | 1.00 |
| Sixth layer (intermediate layer) | |
| EX-5 | 0.040 |
| Tricresyl phosphate (high boiling solvent) | 0.020 |
| Gelatin | 0.80 |
| Fifth layer (Third red sensitive emulsion layer) | |
| Emulsion D | 1.55 |
| Sensitizing dye I | $2.4 \times 10^{-4}$ |
| Sensitizing dye II | $1.0 \times 10^{-4}$ |
| Sensitizing dye III | $3.4 \times 10^{-4}$ |
| EX-2 | 0.097 |
| EX-3 | 0.010 |
| EX-4 | 0.080 |
| Tricresyl phosphate (high boiling solvent) | 0.22 |
| Di-n-butyl phthalate (high boiling solvent) | 0.10 |
| Gelatin | 1.63 |
| Fourth layer (second red sensitive layer) | |
| Emulsion C | 0.85 |
| Sensitizing dye I | $3.5 \times 10^{-4}$ |
| Sensitizing dye II | $1.6 \times 10^{-5}$ |
| Sensitizing dye III | $5.1 \times 10^{-4}$ |
| EX-2 | 0.20 |
| EX-3 | 0.050 |
| EX-6 | 0.015 |
| EX-8 | 0.20 |
| EX-9 | 0.050 |
| U-1 | 0.070 |
| U-2 | 0.050 |
| U-3 | 0.070 |
| Gelatin | 1.30 |
| Third layer (first red sensitive layer) | |
| Emulsion A | 0.20 |
| Emulsion B | 0.30 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.17 |
| EX-6 | 0.020 |
| EX-8 | 0.17 |
| U-1 | 0.070 |
| U-2 | 0.050 |
| U-3 | 0.070 |
| Tricresyl phosphate (high boiling solvent) | 0.060 |
| Gelatin | 0.87 |
| Second layer (intermediate layer) | |
| 2,5-Di-tert-pentadecylhydroquinone | 0.18 |
| EX-1 | 0.18 |
| EX-3 | 0.020 |
| EX-7 | $2.0 \times 10^{-3}$ |
| U-1 | 0.060 |
| U-2 | 0.080 |
| U-3 | 0.10 |
| Tricresyl phosphate (high boiling solvent) | 0.10 |
| Tricresyl phosphate (high boiling solvent) | 0.10 |
| Di-n-butyl phthalate (high boiling solvent) | 0.020 |
| Gelatin | 1.04 |
| First layer (antihalation layer) | |
| Black colloidal silver | 0.18 |
| Gelatin | 1.40 |

The additives for the layers are shown below.

$CH_2=CH-SO_2-CH_2-CONH-CH_2CH_2-NHCO-CH_2-SO_2-CH=CH_2$ H-1

-continued
EX-1
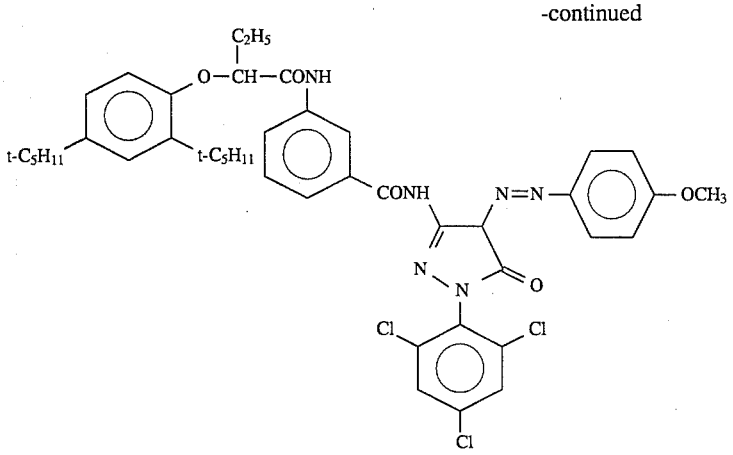
EX-2
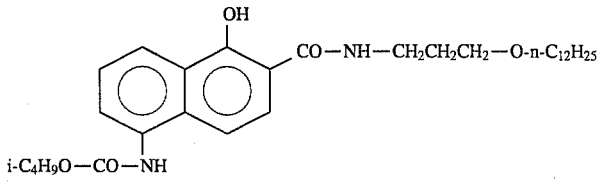
EX-3
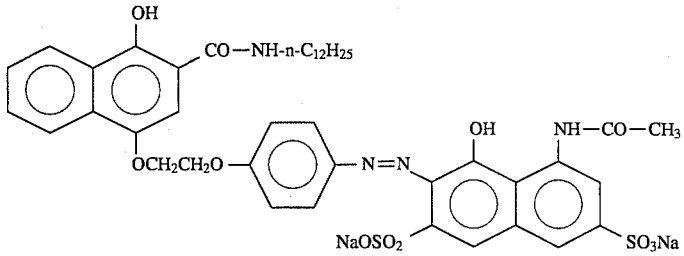
EX-4
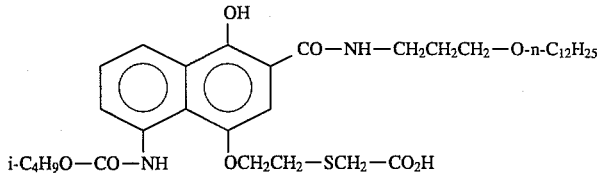
EX-5
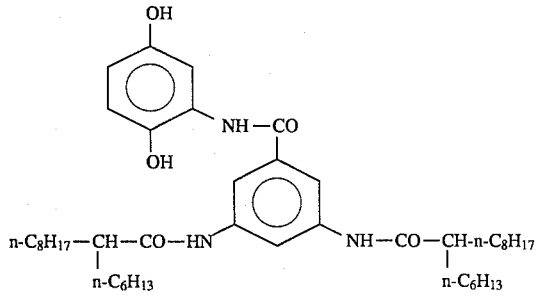
EX-6
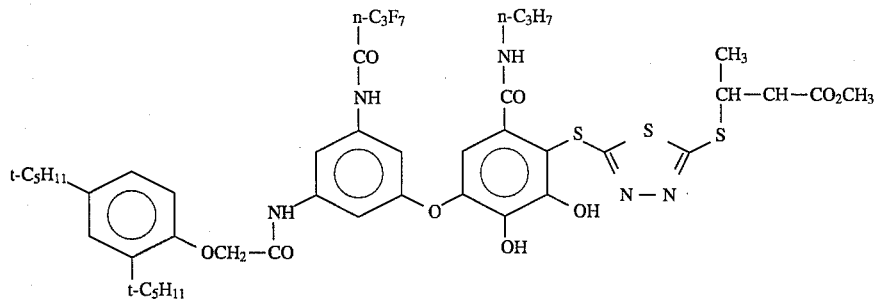

-continued
EX-7
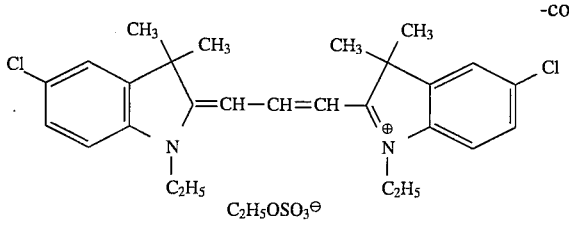
EX-8
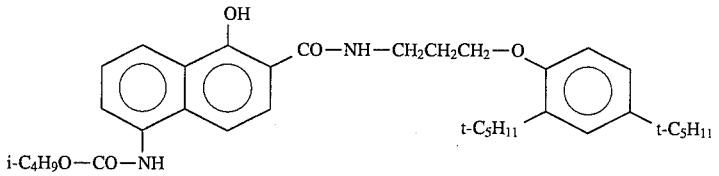
EX-9
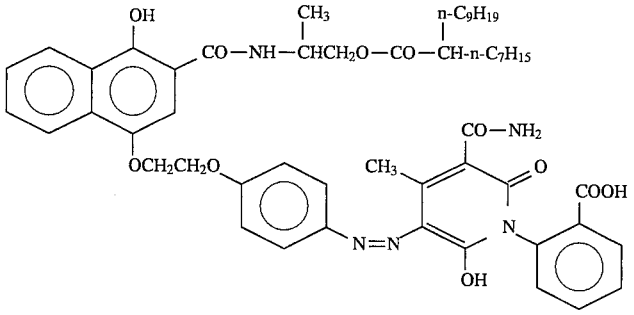
U-1
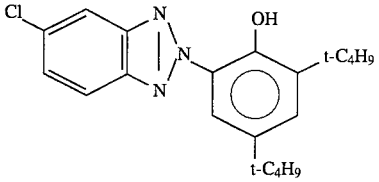
U-2
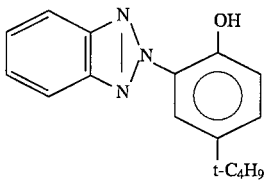
U-3
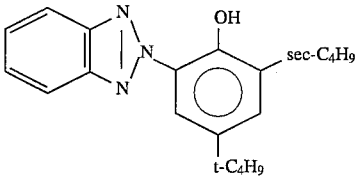
U-4
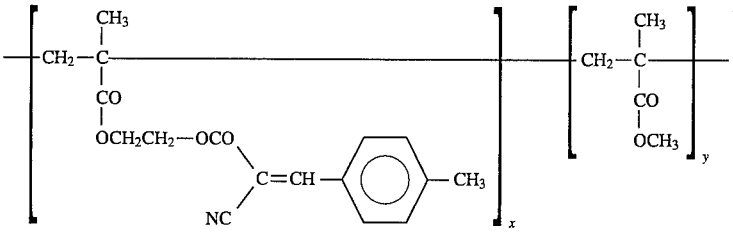
x:y = 70:30 (wt. %)
U-5
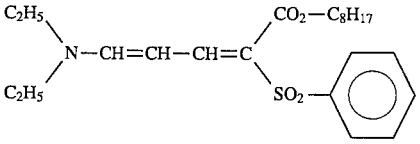
Sensitizing dye I
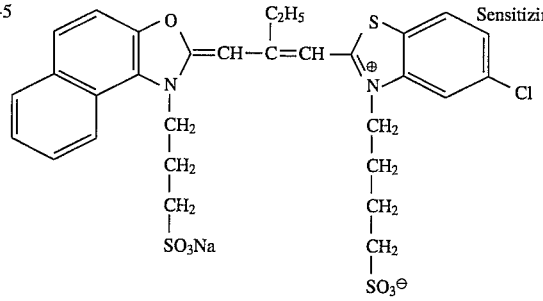

-continued

Sensitizing dye II

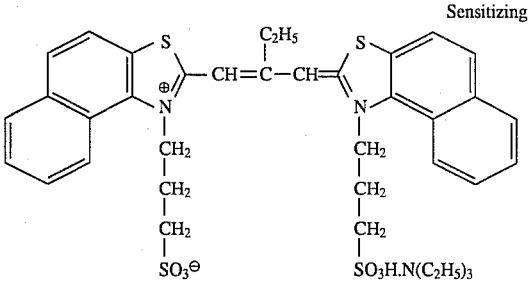

Sensitizing dye III

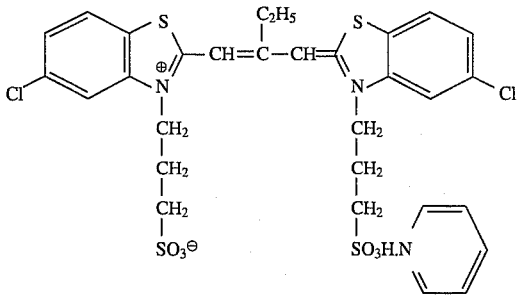

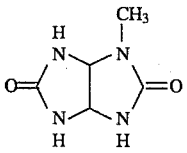

Q-1

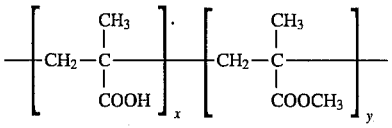

(x/y = 10/90)

B-1

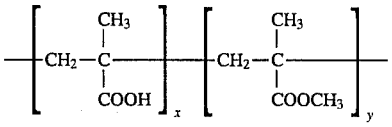

(x/y = 40/60)

B-2

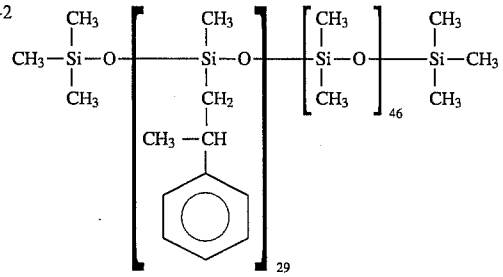

B-3

The following emulsions A to E were used.

A: Monodispersed tetradecahedral emulsion

B: Monodispersed cubic internal latent image emulsion

C: Tabular emulsion (average aspect ratio: 8.0)

D: Monodispersed cubic emulsion

E: Monodispersed cubic internal latent image emulsion

The other characteristics of the emulsions are shown in Table 1. In the Table 1, the grain size means the average diameter of the spheres corresponding to the grains, σ means the distribution coefficient of the grain size, AgI means the silver iodide content in the halide composition of the grains, and the amounts of sensitizing dyes mean the amounts (g) based on 1 mol of silver halide.

TABLE 1

| Emulsion | Grain size | σ (%) | AgI (%) | Amounts of sensitizing dyes (g) S-1 | S-2 | S-3 | S-4 | S-5 |
|---|---|---|---|---|---|---|---|---|
| A | 0.28 | 16 | 3.7 | 0.025 | 0.25 | — | — | 0.01 |
| B | 0.30 | 10 | 3.3 | 0.01 | 0.25 | — | — | 0.01 |
| C | 0.68 | 25 | 2.0 | 0.01 | 0.10 | — | — | 0.01 |
| D | 0.20 | 17 | 4.0 | — | — | 0.5 | 0.1 | — |
| E | 0.28 | 11 | 3.5 | — | — | 0.25 | 0.08 | 0.05 |

The sensitizing dyes S-1 to S-5 are shown below.

S-1

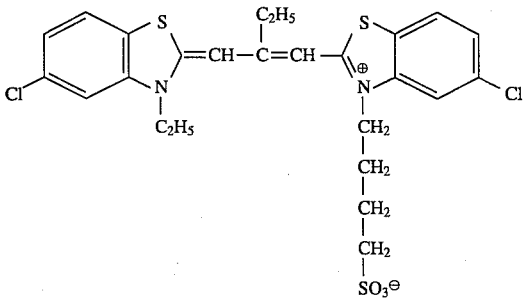

S-2

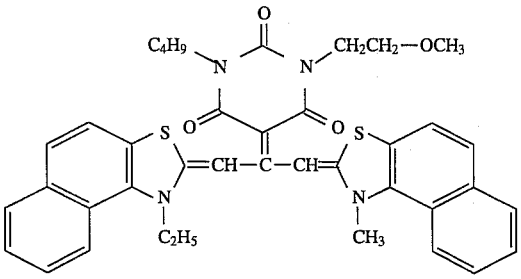

S-3

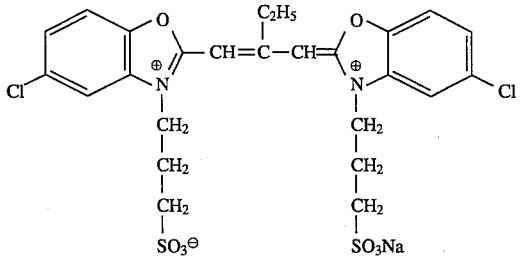

-continued

S-4

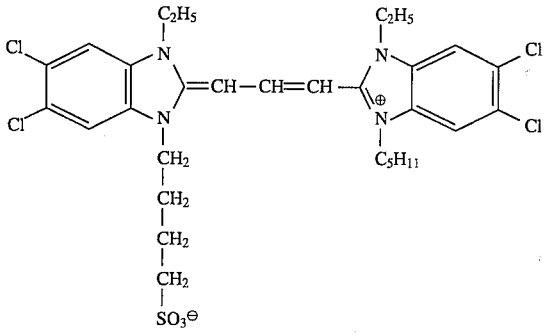

S-5

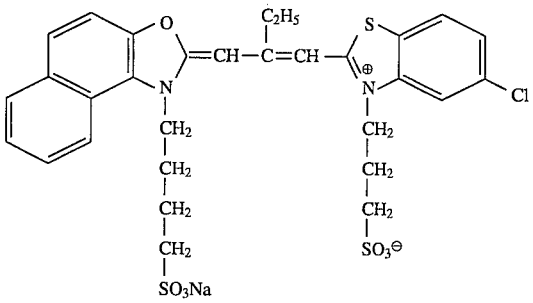

Further, the compounds W-1, W-2, W-3, B-4, B-5, B-6, F-1, F-2, F-3, F-4, F-5, F-6, F-7, F-8, F-9, F-10, F-11, F- 12, F-13, F-15, F-16, an iron salt, a lead salt, a gold salt, a platinum salt, an iridium salt and a rhodium salt were added to each of the layers to improve the stability, the handling, the resistance to pressure, the resistance to mold and bacteria, the antistatic characteristics and the coating characteristics.

W-1

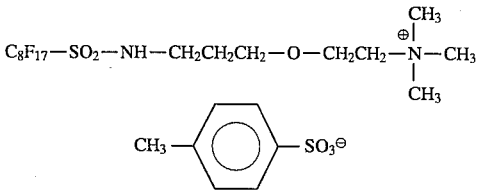

W-2

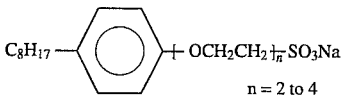

n = 2 to 4

W-3

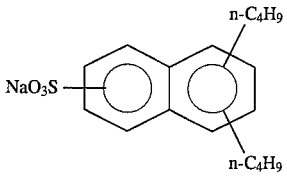

B-4

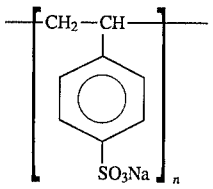

-continued

B-5

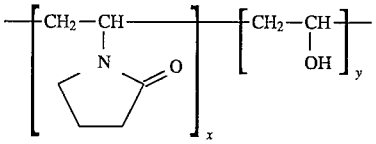

x/y = 70/30

B-6

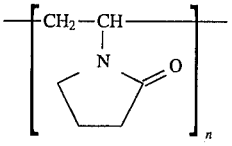

(Average molecular weight: about 10,000)

F-1

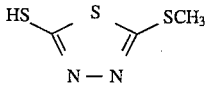

F-2

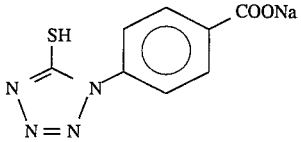

F-3

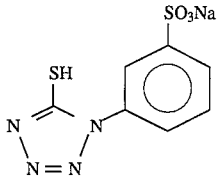

F-4

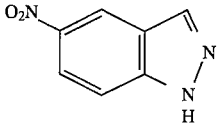

F-5

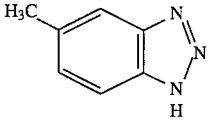

F-6

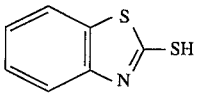

F-7

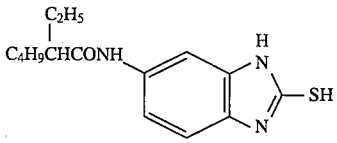

F-8

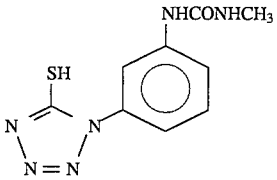

-continued

F-9

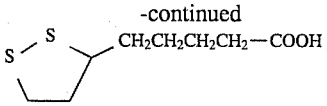

F-10

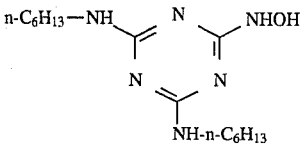

F-11

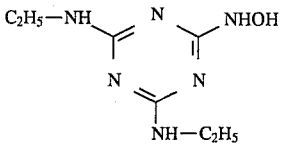

F-12

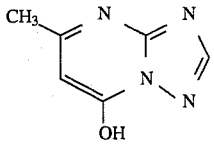

F-13

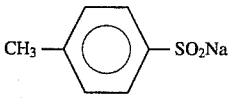

F-14

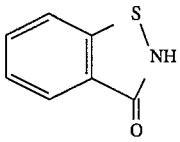

F-15

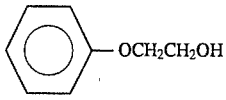

F-16

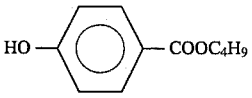

Preparation of samples No. 102 to No. 106

Samples No. 102 to No. 106 were prepared in the same manner as in the preparation of the sample No. 101, except that tricresyl phosphate and di-n-butyl phthalate (high boiling organic solvents) contained in the third and fifth layers were replaced with the polymers of the present invention set forth in Table 2.

Preparation of samples No. 107 and No. 108

Samples No. 107 and No. 108 were prepared in the same manner as in the preparation of the sample No. 101, except that tricresyl phosphate and di-n-butyl phthalate (high boiling organic solvents) contained in the third and fifth layers were replaced with the comparative polymers set forth in Table 2.

Development of samples

The samples were exposed to white light through an optical wedge. The samples were then developed in an automatic developing machine according to the following conditions.

| Processing | Time | Temp. | Replenish | Tank |
|---|---|---|---|---|
| Development | 3:15 | 38° C. | 33 ml | 20 l |
| Bleaching | 6:30 | 38° C. | 25 ml | 40 l |
| Washing | 2:10 | 24° C. | 1,200 ml | 20 l |
| Fixing | 4:20 | 38° C. | 25 ml | 30 l |
| Washing (1) | 1:05 | 24° C. | From (2) | 10 l |
| Washing (2) | 1:00 | 24° C. | 1,200 ml | 10 l |
| Stabilizing | 1:05 | 38° C. | 25 ml | 10 l |
| Drying | 4:20 | 55° C. | | |

(Remark)
Time: Minute:Second
Replenish: Amount of the replenisher based on the sample of 35 mm width and 1 m length
Form (2): Counter current from washing (2)
Tank: Content of the tank The compositions for the processing solutions are shown below.

| | Mother liquid | Replenisher |
|---|---|---|
| **Developing solution** | | |
| Diethylenetriaminetetraacetic acid | 1.0 g | 1.1 g |
| 1-Hydroxyethylidene-1,1-diphosphonic acid | 3.0 g | 3.2 g |
| Sodium sulfite | 4.0 g | 4.4 g |
| Potassium carbonate | 30.0 g | 37.0 g |
| Potassium bromide | 1.4 g | 0.7 g |
| Potassium iodide | 1.5 mg | — |
| Sulfate salt of hydroxylamine | 2.4 g | 2.8 g |
| 4-(N-ethyl-N-β-hydroxyethylamino)-2-methylaniline | 4.5 g | 5.5 g |
| Water (make up to) | 1.0 l | 1.0 l |
| pH | 10.05 | 10.10 |
| **Bleaching solution** | | |
| Ammonium salt of iron (III) ethylenediaminetetraacetate | 100.0 g | 120.0 g |
| Disodium ethylenediaminetetraacetate | 10.0 g | 10.0 g |
| Ammonium bromide | 140.0 g | 160.0 g |
| Ammonium nitrate | 30.0 g | 35.0 g |
| Ammonia water (27%) | 6.5 ml | 4.0 ml |
| Water (make up to) | 1.0 l | 1.0 l |
| **Fixing solution** | | |
| Disodium ethylenediaminetetraacetate | 0.5 g | 0.7 g |
| Sodium sulfite | 7.0 g | 8.0 g |
| Sodium bisulfite | 5.0 g | 5.5 g |
| Aqueous solution (70%) of ammonium thiosulfate | 175.0 ml | 200.0 ml |
| Water (make up to) | 1.0 l | 1.0 l |
| pH | 6.7 | 6.6 |
| **Stabilizing solution** | | |
| Formalin (37%) | 2.0 ml | 3.0 ml |
| Polyoxyethylene-p-monononylphenyl-ether (average polymerization degree: 10) | 0.3 g | 0.45 g |
| Disodium ethylenediaminetetraacetate | 0.05 g | 0.08 g |
| Water (make up to) | 1.0 l | 1.0 l |
| pH | 5.0–8.0 | 5.0–8.0 |

Evaluation of samples

The color density of each of the samples was measured to determine the maximum color density of the red sensitive layer. The results are set forth in Table 2. In the Table 2, the values are relative values where the maximum density (Dmax) of the sample No. 101 is 100.

Further, the samples were stored at 50° C. and the relative humidity of 70% for 3 days. The surfaces of the samples were observed with naked eyes to determine whether an oil was deposited on the surface or not.

Furthermore, two sheets of the samples were laminated while facing the emulsion layers. The laminations were stored at 50° C. and the relative humidity of 70% for 1 day. The samples were peeled from the lamination. The adhesion was observed.

TABLE 2

| Sample No. | Third layer Medium | Third layer Amount | Fifth layer Medium | Fifth layer Amount | Dmax | Oil | Adhesion |
|---|---|---|---|---|---|---|---|
| 101 | HBS-1 | 0.06 g | HBS-1<br>HBS-2 | 0.22 g<br>0.10 g | 1.00 | + | + |
| 102 | P-1 | 0.06 g | P-1 | 0.32 g | 0.98 | – | – |
| 103 | P-2 | 0.06 g | P-2 | 0.32 g | 0.98 | – | – |
| 104 | P-4 | 0.06 g | P-4 | 0.32 g | 1.00 | – | – |
| 105 | P-7 | 0.06 g | P-7 | 0.32 g | 1.02 | – | – |
| 106 | P-15 | 0.06 g | P-15 | 0.32 g | 1.10 | – | – |
| 107 | P-X | 0.06 g | P-X | 0.32 g | 0.66 | – | – |
| 108 | P-Y | 0.06 g | P-Y | 0.32 g | 0.49 | – | – |

(Remark)
Oil: Deposited on the surface (+) or not (–)
Adhesion: Observed (+) or not (–)
HBS-1 Tricresyl phosphate
HBS-2 Di-n-butyl phthalate
P-X

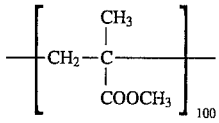

P-Y

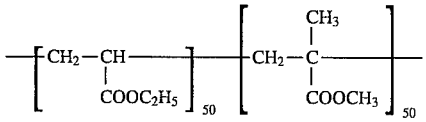

As is shown in Table 2, the samples No. 102 to 108 using polymers is free from the problems of oil deposition and adhesion. Accordingly, the polymer scarcely degrades the membrane properties of the emulsion layer. Further, the samples No. 102 to 106 using the polymers of the present invention as well as the sample No. 101 using high boiling solvents form a color image of a high maximum density, while the samples No. 107 and No. 108 using the comparative polymers form an image of a low maximum density. Therefore, the polymers of the present invention do not decrease the maximum density (the reactivity of the color coupler) while not degrading the membrane properties of the emulsion layer.

EXAMPLE 2

Preparation of coupler dispersion

The following solutions I and II were prepared.

| | |
|---|---|
| Solution I | |
| Gelatin solution (14%) | 71 g |
| Citric acid (10%) | 0.25 g |
| Solution II | |
| Yellow coupler C-1 | 12 g |
| Compounds set forth in Table 3 | 4.7 g |
| Ethyl acetate | 15 ml |
| Sodium dodecylbenzenesulfonate | 0.50 g |

C-1

-continued

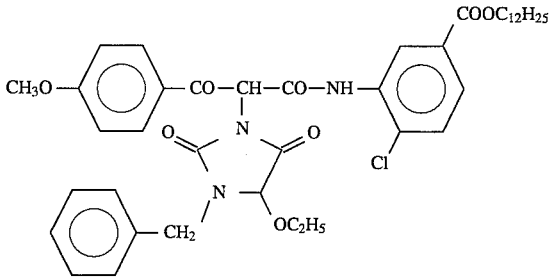

The solutions I and II were mixed at 60° C. The mixture was stirred in a homoblender at 15,000 rpm for 2 minutes. The stirring procedure was repeated three times to obtain a dispersion.

The dispersion was placed in an egg-plant type flask. Ethyl acetate (auxiliary solvent) was removed under reduced pressure at 50° C. for 1 hour in an evaporator. The weight was corrected with water to obtain dispersions 2-1 to 2-6.

The particle size of the dispersion was measured according to a light scattering method (using Master Sizer™ of Malvern). The results are set forth in Table 3.

The dispersion was stored at 5° C. for 1 week. The dispersion was then heated to 40° C., and stored for 24 hours. The heating and storing procedures were repeated twice. The dispersion was filtered through a filter of 3 μm. The filter was dried, the amount of the residue was determined by the change of the weight of the filter. The results are set forth in Table 3.

TABLE 3

| Dispersion | Compound | Particle size | Residue |
|---|---|---|---|
| 2-1 | HBS-3 | 0.23 μm | 25 mg |

TABLE 3-continued

| Dispersion | Compound | Particle size | Residue |
|---|---|---|---|
| 2-2 | P-3 | 0.23 μm | 2.8 mg |
| 2-3 | P-7 | 0.24 μm | 3.5 mg |
| 2-4 | P-8 | 0.23 μm | 1.9 mg |
| 2-5 | P-14 | 0.22 μm | 2.1 mg |
| 2-6 | P-23 | 0.23 μm | 4.3 mg |

(Remark)
HBS-3: Triphenyl phosphate

As is shown in Table 3, the polymers of the present invention as well as the conventional high boiling organic solvent can finely disperse the particles. Further, the dispersions using the polymers are very stable, compared with the conventional dispersions using the high boiling organic solvent. Therefore, the coupler dispersions prepared according to the present invention are free from the problems of aggregation or precipitation.

We claim:

1. A silver halide photographic material comprising at least one silver halide emulsion layer containing a color coupler provided on a support, wherein the color coupler is present in particles of a polymer dispersed in the silver halide emulsion layer, said polymer comprising repeating units represented by the formula (I):

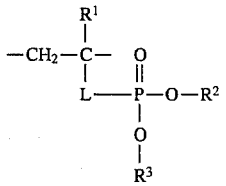

(I)

in which $R^1$ is a hydrogen atom, a halogen atom or an alkyl group having 1 to 4 carbon atoms, each of $R^2$ and $R^3$ independently is an aliphatic group or an aromatic group, or $R^2$ and $R^3$ are combined with the oxygen atoms and the phosphorus atom to form a heterocyclic ring; and L is a divalent linking group selected from the group consisting of —CO—, —O—, —S—, —$NR^4$—, —$SO_2$—, a divalent aliphatic group, a divalent aromatic group and a combination thereof, and $R_4$ is a hydrogen atom or an aliphatic group.

2. The silver halide photographic material as claimed in claim 1, wherein $R^1$ is a hydrogen atom or a methyl group.

3. The silver halide photographic material as claimed in claim 1, wherein each of $R^2$ and $R^3$ independently is an alkyl group, an alkyl group substituted with an alkoxy group, an alkyl group substituted with an aryl group, an aryl group, an aryl group substituted with an alkyl group, an aryl group substituted with an alkoxycarbonyl group or an aryl group substituted with a halogen atom.

4. The silver halide photographic material as claimed in claim 1, wherein $R^2$ and $R^3$ are combined with the oxygen atoms and the phosphorus atom to form a heterocyclic ring of

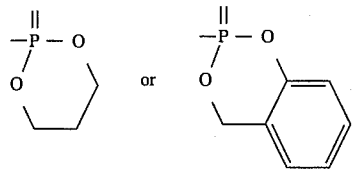

5. The silver halide photographic material as claimed in claim 1, wherein L is a divalent linking group selected from the group consisting of L1 to L8:

L1: —CO—O—AL—O—

L2: —AR—AL—O—

L3: —CO—O—AL—O—CO—AL—O—

L4: —CO—$NR^4$—AR—O—

L5: —CO—$NR^4$—AL—O—

L6: —CO—O—AL—

L7: —AR—AL—

L8: —AR—AL—O—AL— in which the right side is attached to the phosphorus atom and the left side is attached to the carbon atom; AL is a divalent aliphatic group; AR is a divalent aromatic group; and $R^4$ is hydrogen or an aliphatic group.

6. The silver halide photographic material as claimed in claim 1, wherein the polymer is a homopolymer consisting of the repeating units represented by the formula (I).

7. The silver halide photographic material as claimed in claim 1, wherein the polymer is a copolymer comprising the repeating units represented by the formula (I) in the weight ratio of not less than 30 wt. %.

8. The silver halide photographic material as claimed in claim 1, wherein the polymer has a number average molecular weight in the range of 1,000 to 300,000.

9. The silver halide photographic material as claimed in claim 1, wherein the particles of the polymer further contains an organic solvent having a boiling point of not higher than 100° C.

10. The silver halide photographic material as claimed in claim 1, wherein the polymer is present in the silver halide emulsion layer in an amount of 5 to 2,000 wt. % based on the amount of the color coupler.

* * * * *